US005242776A

United States Patent [19]

Doi et al.

[11] Patent Number: 5,242,776

[45] Date of Patent: Sep. 7, 1993

[54] ORGANIC PHOTOSENSITIVE MEMBER HAVING FINE IRREGULARITIES ON ITS SURFACE

[75] Inventors: Isao Doi, Toyonaki; Seishi Ojima, Takatsuki; Kenji Masaki, Ibaragi; Shuji Iino, Hirakata; Izumi Osawa, Ikeda, all of Japan

[73] Assignee: Minolta Camera Kabushiki Kaisha, Osaka, Japan

[21] Appl. No.: 789,021

[22] Filed: Nov. 7, 1991

[30] Foreign Application Priority Data

Nov. 8, 1990 [JP] Japan ..... 2-304996
Nov. 8, 1990 [JP] Japan ..... 2-304999

[51] Int. Cl.[5] ..... G03G 5/147
[52] U.S. Cl. ..... 430/67; 430/66; 430/128; 430/132
[58] Field of Search ..... 430/66, 67, 128, 132

[56] References Cited

U.S. PATENT DOCUMENTS 4,732,834 3/1988 Honda et al. ..... 430/84
4,804,607 2/1989 Atsumi ..... 430/128 X
4,933,247 6/1990 Osawa et al. ..... 430/66
4,952,473 8/1990 Suzuki ..... 430/67

FOREIGN PATENT DOCUMENTS 311259 12/1988 Japan ..... 430/66
2-191964 3/1989 Japan .

OTHER PUBLICATIONS

Abstract of Japanese Patent Publ. 59-146057, Aug. 21, 1984.
Abstract of Japanese Patent Publ. 2-139566, May 29, 1990.

*Primary Examiner*—Roland Martin
*Attorney, Agent, or Firm*—Burns, Doane, Swecker & Mathis

[57] ABSTRACT

The present invention relates to a photosensitive member in which a vacuum thin layer is formed as a surface protective layer on or over the roughened surface of the photosensitive layer.

11 Claims, 11 Drawing Sheets

ORGANIC PHOTOSENSITIVE MEMBER HAVING FINE IRREGULARITIES ON ITS SURFACE

BACKGROUND OF THE INVENTION

The present invention relates to a photosensitive member having a surface protective layer, and in more detail it relates to a photosensitive member in which a surface protective layer is formed on a photosensitive layer the surface of which is made irregular.

Recently a variety of photosensitive layers to be used in the photosensitive member for electrophotography, which are constituted of selenium and other inorganic photoconductive or organic photoconductive materials, have been proposed. In general, those photosensitive layers with low hardness tend to be worn out in repeated usage due to abrasion with transfer paper, cleaning materials, developer and others, and the member becomes readily spoiled.

It is proposed to solve this problem that a surface protective layer is formed on the surface of the photosensitive layer with insufficient hardness.

As such a surface protective layer, vacuum thin layers, for example, a plasma-polymerized layer formed of an adequate organic compound or a vapor deposition layer formed of a metal compound, and the like have been proposed (see, for example, Japanese Patent Laid-Open Publication Sho-60 32055).

A photosensitive member with such a surface protective layer is superior in durability to a corresponding member without a surface protective layer and has satisfactory layer strength in usage for a long time under ordinary temperature and humidity. Its moisture resistance, however, is not enough sufficient after used for a long time. Blurs and flows come to be seen in copied images during repeated usage under high humidity.

Organic photosensitive members prepared by a coating method have very smooth surface due to so-called leveling effect characteristic to the coating method. For example, in terms of the ten-point mean roughness (Rz) specified in JIS-B-0601, only about 0.05 μm of the surface roughness is observed. Not only in the case of using a substrate with smooth surface for the preparation of a photosensitive member but also in the case of using a substrate with so rough a surface as 0.5 to 1 μm, the formation of a photosensitive layer having about 20 μm thickness on the substrate will ordinarily give a surface of the photosensitive layer with so low a roughness as described above.

However, the direct formation of a vacuum thin layer on such a so smooth photosensitive layer will cause such problems as rise of residual potential and occurrence of black thread-like noise in copied images when the photosensitive member is used in an actual copying process.

According to the knowledge of the present inventors, these problems are considered to derive from the presence of residual potential accumulated near the interface of the organic photosensitive layer and the vacuum thin layer.

The organic photosensitive layer and the vacuum thin layer are essentially different in nature in regard to constituted materials and processing.

The photocarrier coming through the organic photosensitive layer cannot enter into the vacuum thin layer since there are no triggers at the interface between the vacuum thin layer and the organic photosensitive layer, and is considered to be gradually accumulated in the vicinity of the interface to be observed as the rise of residual potential.

In a copying machine, mechanical pressure by developer, cleaning blade and others affect on the surface of the photosensitive member causing partial compression against the organic photosensitive layer via the vacuum thin layer to form minute irregular shapes on the interface in the direction of rotation of the member. Such minute irregularities serve as triggers and the photocarrier passes the vacuum thin layer through such spots to combine with the electrical charges on the utmost surface allowing no accumulation of residual potential. It is thought that black thread-like image noise are formed because of the difference between the residual potential in the minute irregular parts and that in the parts with no such irregularities.

The different nature of the organic photosensitive layer and the vacuum thin layer has not been explained clearly in physical terms so far as the present inventors are aware. It is noted by the way that such a phenomenon has also been observed in negatively chargeable photosensitive member when the ionization potentials of the organic photosensitive layer and of vacuum thin layer are nearly equal or when the ionization potential of the vacuum thin layer is rather lower.

The present invention has been completed in reference to these situations, and solves the above problem by forming a surface protective layer comprised of a vacuum thin layer on the photosensitive layer, after a roughing treatment of the surface of the photosensitive layer, instead of conventional direct formation of a surface protective layer on intact photosensitive layer with no roughing treatment.

Techniques of roughing surface of the photosensitive member are reported in Japanese Patent Laid-Open Publication Hei-2 139566, Sho-59 146057 and others, but the photosensitive member with roughened surface specified in the present invention is quite different from these ones in regard to the extent and the object of roughing as well as the purpose and effects of the invention.

SUMMARY OF THE INVENTION

The object of the present invention is to provide a photosensitive member having a vacuum thin layer as a surface protective layer, showing excellent moisture resistance even after repeated use.

Further object of the present invention is to provide a photosensitive member having a vacuum thin layer as a surface protective layer, not showing rise of residual potential, lowering of sensitivity and noises in copied images such as black threads and blurs, even after repeatedly used.

The present invention relates to a photosensitive member constructed by forming a vacuum thin layer serving as a surface protective layer on a photosensitive layer after the surface of the photosensitive layer is treated to be roughened, instead of conventional direct formation of a surface protective layer which is not pretreated on the photosensitive layer.

DETAILED DESCRIPTION OF THE INVENTION

The present invention provides a photosensitive member having a photosensitive layer on an electrically conductive substrate and a surface protective layer formed of a vacuum thin layer on the photosensitive layer, which shows excellent moisture resistance even after repeatedly used and does not develop rise of residual potential, lowering of sensitivity and occurrence of copied image noises (for example, black threads, blur and flow of copied image).

The above object can be achieved by processing to rough the surface of the photosensitive layer prior to the formation of a vacuum thin layer on the photosensitive layer.

In the photosensitive member of the present invention, a photosensitive layer is formed on an electrically conductive. Such a photosensitive layer is not specifically limited provided that it is a photosensitive layer requiring a surface protective layer in general. Actually may be mentioned as examples, selenium photosensitive layer such as comprised of a single layer of selenium-arsenic alloy and of a laminated layer of selenium and selenium-tellurium alloy in this order, organic photosensitive layer formed by dispersing various photoconductive substances in an adequate resin and photosensitive layer constructed by forming a resin layer over a-Si photosensitive layer and other photosensitive layers with high hardness.

In the present invention, the surface of the photosensitive layer is roughened by forming innumerable linear scratches which cross each other. In the present invention the linear scratches are formed to keep definite shape and surface roughness (depth of scratches) as specified below.

The shape of scratches concerns particularly copied image noises (cleaning residue, scratches etc.), wear of blade and moisture resistance while the surface roughness concerns sensitivity, adhesive property and others.

Figure 1:
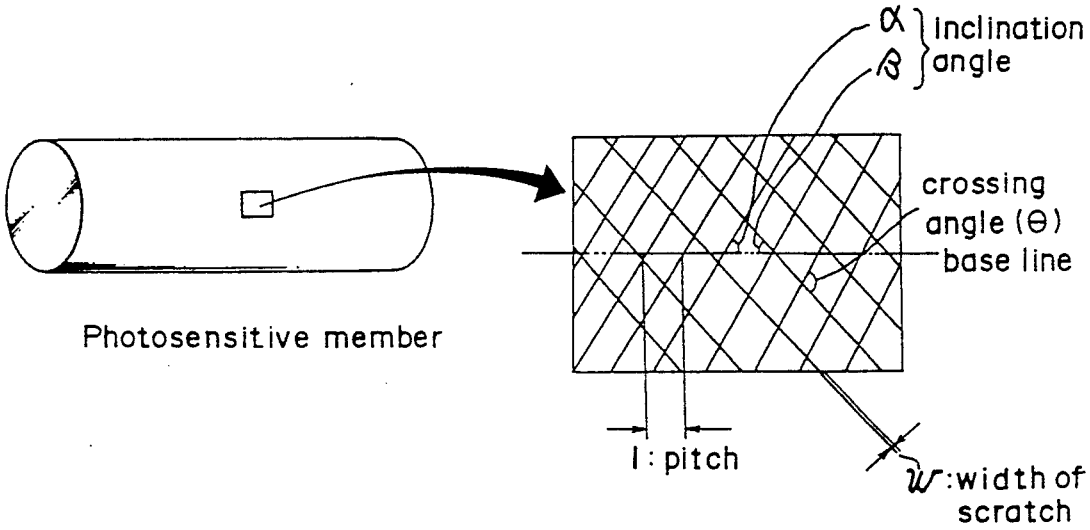
FIGS. 1 and 2 are respectively a schematic view of linear scratches on a surface of photosensitive layer.

In FIG. 1, a part of the surface of the photosensitive layer is withdrawn to show schematically the shape of scratches.

Figure 2:
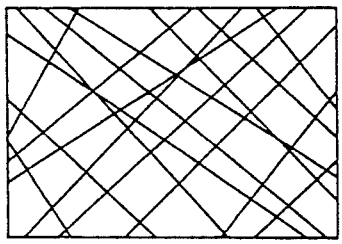

Scratches in regular shape are shown in FIG. 1 while they may be irregular or indefinite in shape as shown in FIG. 2.

The shape of scratches is defined by crossing angle ($\theta$ (°)), inclination angle ($\alpha$, $\beta$(°)), pitch (l ($\mu$m)) and width (w ($\mu$m)).

In the present invention, the crossing angle is 30° to 150°, preferably 60° to 120°, and the inclination angles ($\alpha$, $\beta$) are both 15° to 75°, preferably 30° to 60°. When they are smaller than these values, there occur such problems as toner filming and fusion of toner, wear of blade and copied image-noise. When they are larger than the above, cleaning residue of toner, picture noise and other problems may take place.

Pitch (l) is less than 200 $\mu$m, preferably less than 120 $\mu$m. The lower limit is not defined but the pitch of about 1 $\mu$m is sufficient.

The width of scratch (w) is less than 30 $\mu$m, preferably less than 20 $\mu$m. The lower limit is about 1 $\mu$m. Too large a pitch or width of the scratches will eliminate the improving effect on moisture resistance and lower resolving power of copied image.

In the present invention the shape of scratches ($\theta$, $\alpha$, $\beta$, l and w) is given by obtaining these parameters as follows.

For the first place, photographs (one each for magnification $\times$75 and $\times$300) of a part of surface of a photosensitive member are taken under optical microscope after roughening process of a photosensitive layer or after formation of a vacuum thin layer. Then, a part defined by 0.25 mm length in the right-angled direction to the moving direction to the photosensitive member in actual operation of copying machine is taken in photographs and this direction of 0.25 mm length is made a base line.

The crossing angle ($\theta$) (°) of scratch is obtained by determining, on each scratch crossing the base line, the angle formed by the adjoining scratches in the right upper direction and in the left upper direction (the angle in the position in the direction parallel to the base line), and the arithmetic mean is represented by $\theta$.

The inclination angles ($\alpha$, $\beta$) (°) of scratches are obtained by determining the angles formed between crossing scratch lines and the base line, and the arithmetic means are represented as $\alpha$ and $\beta$ ($\alpha$: the angle between the scratch in the right upper direction and the base line; $\beta$: the angle between the scratch in the left upper direction and the base line).

The pitch (l) ($\mu$m) of scratch is obtained by determining the distance between the adjoining crossing points of the base line and scratches, and the arithmetic means is shown as l.

The width of scratches crossing the base line is determined and the arithmetic mean is given to be w.

The arithmetic means of these parameters obtained in more than 3 parts randomly taken from the surface of the photosensitive member are made to be within the above shown ranges.

The surface roughness (depth of scratches) of the vacuum thin layer is defined by maximum height (Rt), ten point-mean roughness (Rz), center line mean roughness (Ra), square mean roughness (RMS) and mean mountain distance (Sm) in rough surface.

Particularly in the case where such a shape of scratches as described above is formed, definition of the maximum height (Rt) of the surface protective layer made of a vacuum thin layer or center line mean roughness (Ra) will achieve improvement of copied image noise and moisture resistance, and further it will improve adhesive property and prevent lowering of sensitivity.

The maximum height (Rt) ($\mu$m) is 0.05 to 0.4 $\mu$m, preferably 0.06 to 0.3 $\mu$m.

The center line mean roughness (Ra) is 0.008 to 0.025 μm, preferably 0.009 to 0.02 μm.

When the maximum height (Rt) or the center line mean roughness (Ra) is less than the above ranges, there may be no effect on the improvement of moisture resistance while when either is more than the above range there will be such problems as deterioration of adhesive property required for a surface protective layer, defect in layer, filming and fusion of toner and occurrence of copied image noises.

Figure 3:
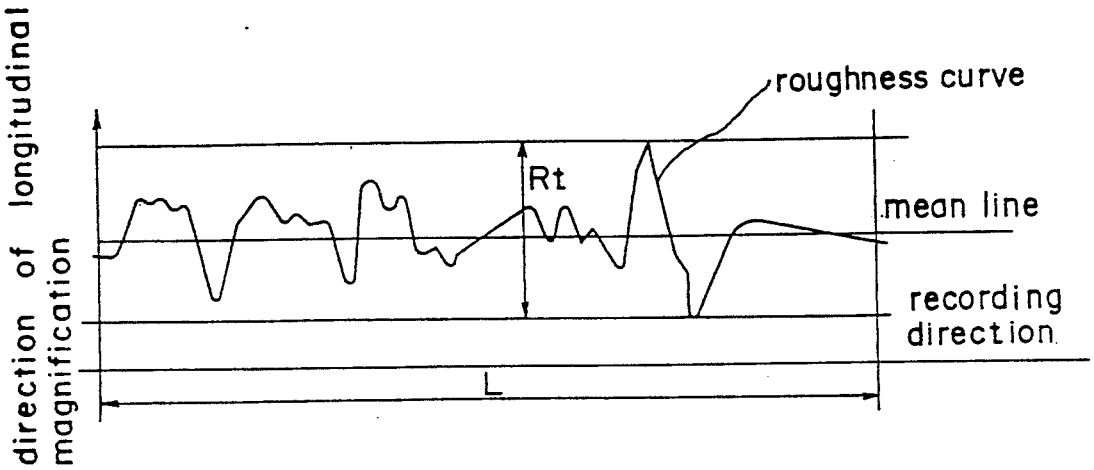
FIG. 3 is a diagram for explaining maximum height.

The maximum height (Rt) is obtained by determining the distance, in the direction of longitudinal magnification of a sectional curve, between the 2 lines that run in parallel to the mean line of the part withdrawn from the roughness curve by the standard length and contain the part in between, as shown in FIG. 3, and the determined value is given in micrometer (μm).

The "roughness curve" denotes the curve obtained by cutting off the wavy component of the surface longer than 0.025 mm of wavelength from the sectional curve (the outline appearing on the cut surface when the object to be determined is cut) of the standard length.

The "standard length" is the length of the part withdrawn in a definite length from the sectional curve. In the present invention, 2.5 mm is employed as the standard length.

The center line mean roughness (Ra) is obtained from the following equation after a part with the length for measurement (l) is withdrawn from the roughness curve in the direction of the center line, and the center line of this withdrawn part is made X-axis while the direction of the longitudinal magnification is made Y-axis for expressing the roughness curve as y=f(x), and the obtained value is shown in micrometer (μm):

$$Ra = \frac{1}{l}\int_0^l |f(x)|\,dx \quad (l: 2.5\ \text{mm})$$

The "center line" denotes the line which, when a line is drawn in parallel to the mean line of the roughness curve, gives equal area encircled by the roughness curve and this line on its both sides.

When improvement of adhesive property and increase of sensitivity are desired in particular, they may be achieved by defining the surface roughness, particularly the maximum height (Rt) and mean mountain distance of rough surface (Sm), or ten point-mean roughness (Rz) and Sm, or square mean roughness (RMS) and Sm or center line mean roughness (Ra) and Sm.

It is advised to process for roughening so as to obtain the maximum height (Rt) of preferably not less than 0.05 μm and not more than 0.4 μm, more preferably not less than 0.06 μm and not more than 0.3 μm and mean mountain distance (Sm) of preferably not more than 30 μm, more preferably not more than 25 μm.

When the maximum height (Rt) is smaller than 0.05 μm, there are brought about lowering of sensitivity, black thread-like copied image noise and defective adhesion of the surface protective layer.

On the contrary, when the maximum height is larger than 0.4 μm, there occur such problems as image noise due to abrasion flaw, defective layer and filming of toner. When the mean mountain distance (Sm) is larger than 30 μm there arise lowering of sensitivity, black thread-like image noise and defective adhesion of the surface protective layer.

Figure 4:
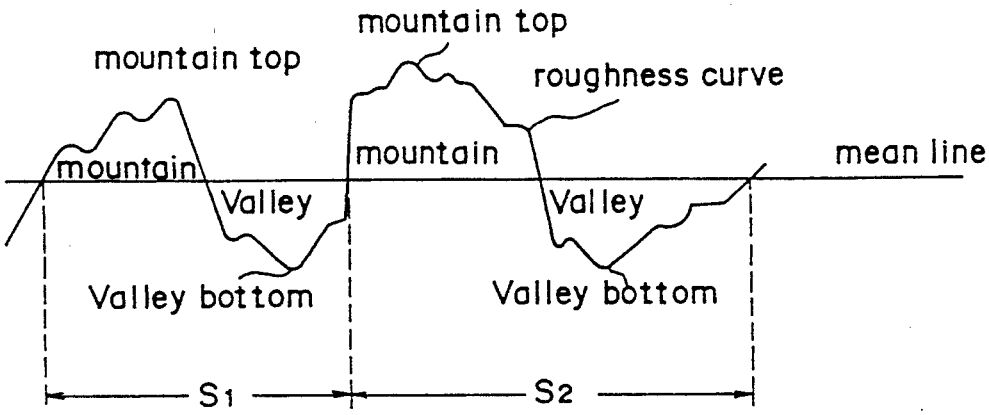
FIG. 4 is a diagram schematically depicting a partial sectional curve of a surface of photosensitive layer.

The mean mountain distance of rough surface (Sm) is the mean value of the sum of the distances between adjoining mountains and valleys ($S_1$, $S_2$ and so on in FIG. 4) and is expressed by μm. Sm corresponds to the density of fineness of roughened surface.

Similar effects may be achieved by defining the ten point-mean roughness (Rz) and the mean mountain distance (Sm), the center line mean roughness (Ra) and the mean mountain distance (Sm) or the square mean roughness (RMS) and the mean mountain distance (Sm).

The ten point-mean roughness (Rz) is preferably not less than 0.045 μm and not more than 0.35 μm, more preferably not less than 0.05 μm and not more than 0.25 μm, and it is preferable to roughen the surface so as to make the mean mountain distance (Sm) not more than 30 μm, more preferably not more than 25 μm.

The center line mean roughness (Ra) is preferably not less than 0.008 μm and not more than 0.025 μm, more preferably not less than 0.009 μm and not more than 0.02 μm, and it is preferable to roughen the surface so as to make the mean mountain distance (Sm) not more than 30 μm, more preferably not more than 25 μm.

The square mean roughness (RMS) is preferably not less than 0.009 μm and not more than 0.035 μm, more preferably not less than 0.01 μm and not more than 0.03 μm, and it is preferable to roughen the surface so as to make the mean mountain distance (Sm) not more than 30 μm, more preferably not more than 25 μm. There is no lower limit for Sm but it is sufficient for Sm to be about 1 μm.

When the ten point-mean roughness (Rz), center line mean roughness (Ra) and square mean roughness (RMS) are without the preferable range, there may take place similar problems as described in the explanation of the maximum height (Rt).

The photosensitive member with a vacuum thin layer formed on the finely roughened organic photosensitive layer does not have such problems as lowering of sensitivity, rise of residual potential and occurrence of black thread-like noise in copied image.

Ten point-mean roughness (Rz) is the difference, expressed by micrometer (μm), between the mean value of the heights of peaks from the highest to the 5th and the mean value of the depths of the valley bottoms from the deepest to the 5th as estimated in the direction of longitudinal magnification from the line running in parallel to the mean line and not crossing the roughness curve, in the part withdrawn from the roughness curve by the standard length.

The "mean line" is a straight line, in the part withdrawn from the roughness curve, to be determined such that the sum of the squares of the deviation from this straight line to the roughness curve is set to be minimum.

The "peak" means the highest point in a mountain in the roughness curve.

The "valley bottom" means the deepest point in a valley in the roughness curve.

Figure 17:
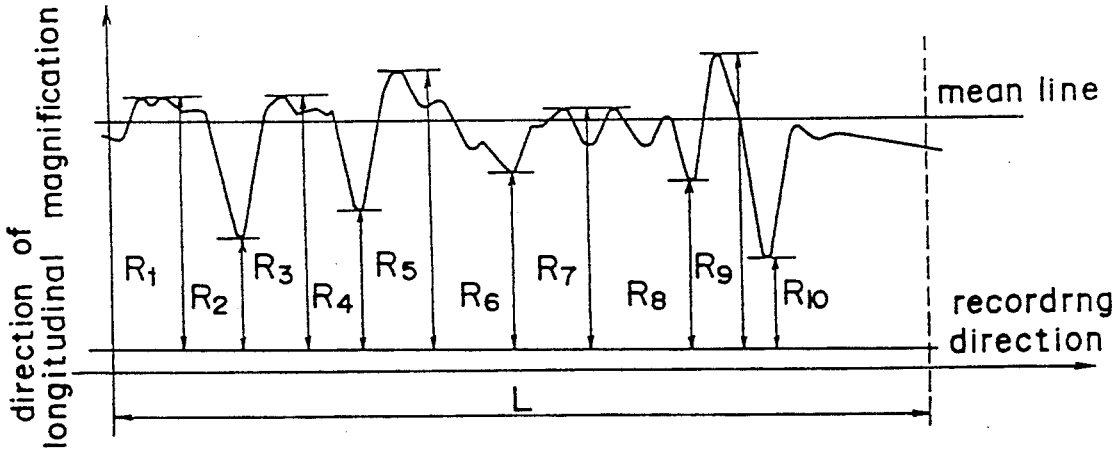
FIG. 17 is a diagram for explaining ten point-mean roughness.

In reference to FIG. 17, the ten point-mean roughness (Rz) may be obtained from the following equation:

$$Rz = \frac{(R_1 + R_3 + R_5 + R_7 + R_9) - (R_2 + R_4 + R_6 + R_8 + R_{10})}{5}$$

L: Standard length (2.5 mm)

$R_1$, $R_3$, $R_5$, $R_7$, $R_9$: Heights of peaks from the highest to the fifth in the withdrawn part corresponding to the standard length L.

$R_2$, $R_4$, $R_6$, $R_8$, $R_{10}$: Depths of the valley bottoms from the deepest to the fifth in the withdrawn part corresponding to the standard length L.

Square mean roughness (RMS)

A part of the length l for determination is withdrawn in the direction of the center line from the roughness curve, and when the center line in this part is made X-axis and the direction of longitudinal magnification Y-axis for representing the roughness curve as y=f(x), the value, expressed by micrometer (μm), obtained from the following equation is the square mean roughness (RMS):

$$RMS = \sqrt{\frac{1}{l}\int_0^l |f(x)^2|\,dx} \quad \text{(standardlength}\,l\text{: 2.5 mm)}$$

The maximum height (Rt), ten point-mean roughness (Rz), center line mean roughness (Ra), square mean roughness (RMS) and mean mountain distance of rough surface (Sm) in the present invention are determined according to the methods described in JIS-B0601-1982. All of the values concerning the surface roughness in the present invention are arithmetic means after determination in randomly withdrawn parts (more than 3 parts) from the surface of photosensitive members.

The methods of roughening the surface of a photosensitive layer by forming crossing linear scratches are not specifically limited, and such a mechanically abrasion method (buff abrasion, brush abrasion etc.), in which a sheet-like felt made by compounding natural fibers (wool, hair of deer, rabbit and other animals, cotton, linen etc.), chemical fibers (rayon, acetate, nylon, polypropylene, acryl, polyester, teflon etc.), glass fiber, stainless steel fiber or others with a resin, or a sheet-like felt made of these materials by entwisting by the action of moisture, heat or pressure to a sheet-form, cloths made of these fibers or brush made of these fibers is used for rubbing under pressure, may be mentioned as examples.

In the case of applying these mechanical abrasion techniques, an abrasive (particles comprised of resin or inorganic substance), water, surfactant, cutting oil and others may or may not be used between the abrasion member and the photosensitive layer. When an abrasive is to be used, an abrasive powder may be used after embedding in or binding to felt, cloth or brush.

The roughness of the surface may be controlled by selecting kind, size, thickness and density of fibers, and, when an abrasive powder is used, by selecting kind, shape, size, size distribution and amount of the abrasive powder, and also by adjusting the pressing and rubbing power of the abrasion machine.

It is particularly effective to roughen the surface of the photosensitive layer by applying buff or brush abrasion while pure water or other liquid containing a dispersed abrasive powder is delivered in the case where the photosensitive layer is formed by the dipping technique to give a very smooth surface.

For example for roughening a drum, 80 mm in diameter×330 mm long, of the photosensitive member containing an organic photosensitive layer of the dispersed resin type by buff abrasion by using a disc buff (20 cm in diameter) made of wool felt, employment of the following conditions will give the roughness of the surface suited to the present invention:

Abrasive: WA#6000

(Trade name, made by Fujimi kemmazai K.K.)

Amount of abrasive used: 2.5 g/l

Delivering volume: 1 l/minute

Drum rotation speed: 100 to 500 rpm

Buff rotation speed: 50 to 1,000 rpm

Buff feed: 0.3 to 5 cm/second

Center deviation of buff: 4.5 to 6 cm

Buff load: 0.5 to 7 kg

These conditions are shown as example and do not limit those required for achieving the surface roughness of the present invention.

In the present invention it is also required to adjust the angles (θ, α and β) of the linear scratches on the surface of the photosensitive layer.

When the surface is roughened by applying buff abrasion to produce linear scratches in the surface, the angles of the scratches may be adjusted from the following equations:

$$\tan\alpha = \frac{Bv\cos\delta + Bx}{Bv\sin\delta + Dy}$$

$$\tan\beta = \frac{Bv\cos\delta - Bx}{Bv\sin\delta + Dy}$$

where, $\theta = \alpha + \beta$, $$\tan\delta = \frac{\sqrt{(R/2)^2 - L^2}}{L}$$

In these equations,

Bv: Velocity component in the tangential direction at the outer fringe of buff,

Bx: Velocity component of buff motion by scanning in the longitudinal direction of the photosensitive member, Dy: Velocity component in the tangential direction at the outer surface of drum, R: Diameter of buff, and L: Deviation of buff center.

Accordingly the angles of scratches may be controlled as desired by adjusting the rotation speeds of buff and the photosensitive drum and the moving velocity and center deviation of buff.

Figure 13:
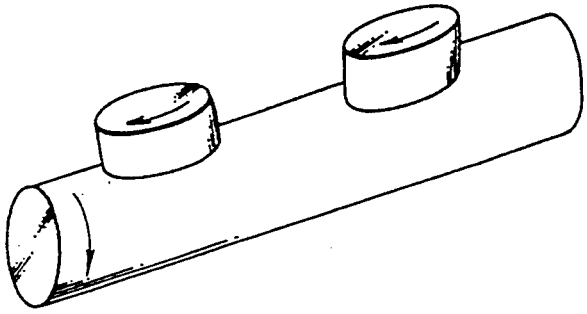
FIGS. 13 to 16 are views showing various type of buff abrasion methods.
Figure 14:
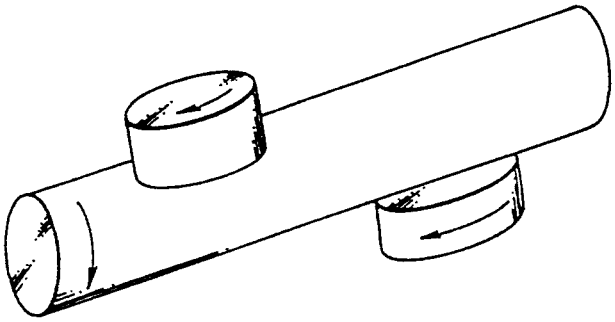
Figure 15:
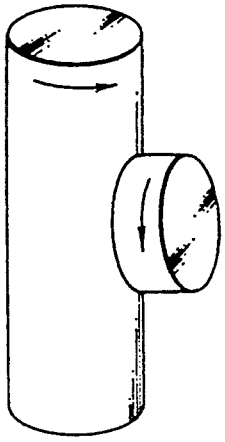
Figure 16:
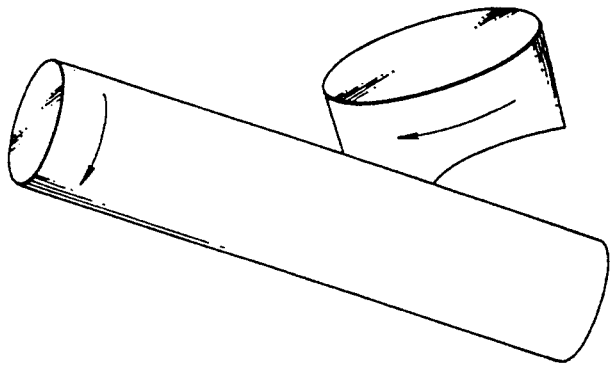

For conducting buff abrasion, plural buffs may be employed as shown in FIGS. 13 and 14. The drum may also be installed in non-parallel state for buff abrasion as shown in FIG. 15. Also it is possible to carry out abrasive processing by using buff in half-contact state as shown in FIG. 16.

Other methods include a sand-blasting method in which abrasive particles are blasted toward the surface of a photosensitive layer. It is also possible to finely roughen the surface of a photosensitive layer by forming the layer by using a coating solution to which silica or other fine particles have previously been added.

Figure 5:
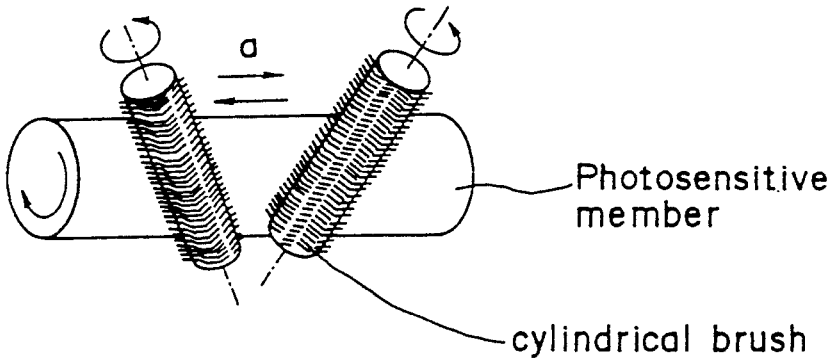
FIGS. 5 and 6 are respectively a view for explaining a method of brush abrasion.

In conducting brush abrasion, 2 brush rollers are set in non-parallel state and while the photosensitive member is rotated the brush rollers are made engaged in a reciprocating motion in the direction of arrow a to effect pressing rotation as shown in FIG. 5.

Figure 6:
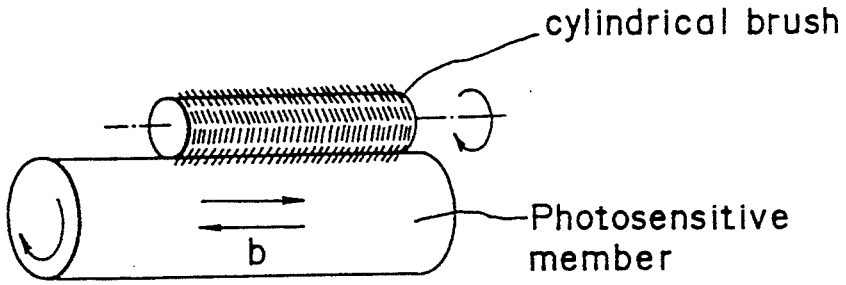

The brush abrasion may also been conducted as shown in FIG. 6 by installing a brush roller parallel to the longitudinal direction of a photosensitive member and making the roller to do press rotation during its being engaged in a reciprocating motion in the direction of arrow b.

The angles ($\theta$, $\alpha$ and $\beta$) of the surface scratches may be controlled by adjusting properly the relative positions, rotating speeds, moving velocities and other factors of the brush roller and the photosensitive member.

Figure 7:
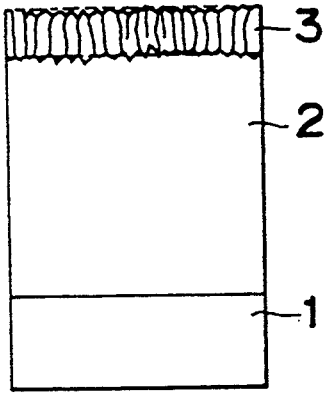
FIGS. 7 and 8 are respectively a schematic sectional view of the photosensitive member.

A vacuum thin layer is formed on the photosensitive layer with scratches as described above to make a surface protective layer. In this way, a photosensitive member in which a photosensitive layer (2) and a surface protective layer (3) are formed in this order on an electrically conductive substrate (1) can be obtained (FIG. 7). As such a surface protective layer (3) may be exemplified by amorphous hydrocarbon layer formed by a plasma polymerization method or a layer of metal compound formed by the application of such methods as vapor deposition, spattering, ion plating and other so-called vacuum thin layer-forming techniques on such metal compounds as $Al_2O_3$, $Bi_2O_3$, $Ce_2O_3$, $Cr_2O_3$, $In_2O_3$, MgO, SiO, $SiO_2$, $SnO_2$, $Ta_2O_3$, TiO, $TiO_2$, $ZrO_2$, $Y_2O_3$ and other metal oxides, $Si_3N_4$, $Ta_2N$ and other metal nitrides, $MgF_2$, LiF, $NdF_3$, $LaF_3$, $C_3F_2$, $CeF_3$ and other metal fluorides, Sic, TiC and other metal carbides and ZnS, CdS and PbS and other metal sulfides.

Figure 8:
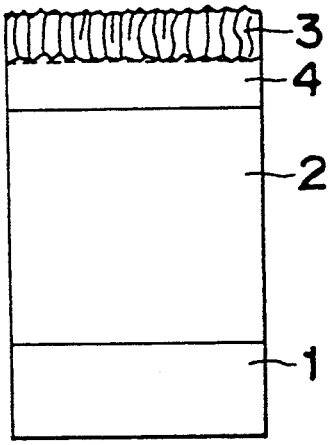

Before the formation of a surface protective layer (3) by the plasma polymerization, spattering, ion plating or other method, a photosensitive member may be given a resin layer (4) on the photosensitive layer (2) in advance so as to protect the photosensitive layer from deterioration by impact of electrons or ions or by heat and other factors in the plasma (see, for example, Japanese Patent Laid-Open Publication Hei-1 133063)(FIG. 8). Irrespective of the kind of photosensitive layer employed, application of the present invention to a photosensitive member with such a structure can improve its durability and moisture resistance, and durability and lowering of sensitivity (occurrence of black threads) even after a long operation.

Caused by the layer stress inherent to the vacuum thin layer on the surface of the photosensitive layer, on which roughing treatment has been applied according to the present invention, numerous cracks are formed in the layer thickness direction in the thin layer. As a result numerous spots are isolated like numerous islands on the surface of the photosensitive layer. Therefore, blurs of copied images and drifts of surface charges which cause flows of copied images can be prevented by the presence of such cracks so that such problems as lowering of moisture resistance and occurrence of blurs, distortion and other deformations in copied images are thought to be eliminated even after long usage.

The present invention can also effect prevention of rise of residual potential after repeated copying and occurrence of thread-like noises in copied images due to lowered sensitivity. These effects are remarkable when the surface protective layer is formed on an organic photosensitive layer or a resin layer. This is considered to be due to that the electrical charges accumulated on the interface between the surface protective layer and the photosensitive layer leak through the above-mentioned cracks to neutralize the electrical charges of reverse polarity.

The thickness of the surface protective layer is, when it is assumed to be formed on a mirror-like smooth surface with no minute roughness, 0.01 to 5 μm, more preferably 0.04 to 1 μm. With such a thin thickness, the irregular shape on the surface of the photosensitive layer is reproduced almost intactly on the surface protective layer. When the layer is more than 5 μm thick, the cracks considered to be caused by internal stress inherent to a vacuum thin layer are not formed and the above discussed problems remain unsolved. When the layer is less than 0.01 μm thick, the layer strength is so lowered that flange, shaving and other defects in the layer may take place showing that the layer is not satisfactory.

Below are given examples for explaining the present invention in more detail.

Preparation of a photosensitive member is made by the combinations of the photosensitive layer, roughening treatment of the photosensitive layer and the surface protective layer which are described below and summarized in Table 1.

Table 2 shows the cases of preparation of a photosensitive member, in which an additional resin layer is formed on the surface of a photosensitive layer and the resin layer is roughened.

Surface shape properties ($\theta$, $\alpha$, $\beta$ and w), surface roughness (Rt and Ra) and various characteristics of prepared photosensitive members (moisture resistance, copied image noises due to scratches on photosensitive member, copied image noises due to insufficient toner-cleaning, black threads, toner fusion, blade wear, adhesive property, layer defect and lowering of sensitivity) are also included in Tables 1 and 2.

TABLE 1

| Example No. | Photosensitive layer | O.C. layer | Roughening method of photosensitive layer | Shape of scratches and surface roughness | | | | | |
|---|---|---|---|---|---|---|---|---|---|
| | | | | $\theta$ (°) | $\alpha,\beta$ (°) | l [μm] | w [μm] | Rt [μm] | Ra [μm] |
| 1 | Organic (a) | PAC(1) | Buff (wool) | 111 | 60 | 10 | 6 | 0.086 | 0.01 |
| 2 | Organic (a) | PAC(1) | Buff (wool) | 102 | 53 | 21 | 5 | 0.089 | 0.009 |
| 3 | Organic (a) | PAC(2) | Buff (wool) | 92 | 45 | 8 | 5 | 0.081 | 0.009 |
| 4 | Organic (b) | PAC(1) | Buff (wool) | 115 | 56 | 28 | 6 | 0.111 | 0.01 |
| 5 | Organic (a) | PAC(2) | Brush (rayon) | 128 | 60 | 35 | 3 | 0.191 | 0.013 |
| 6 | Organic (b) | PAC(1) | Brush (rayon) | 87 | 44 | 153 | 9 | 0.073 | 0.011 |
| 7 | Organic (a) | SiO | Buff (wool) | 65 | 38 | 18 | 8 | 0.194 | 0.009 |
| 8 | Organic (b) | $Al_2O_3$ | Buff (wool) | 130 | 72 | 16 | 13 | 0.072 | 0.012 |
| 9 | Se type (c) | PAC(1) | Buff (wool) | 110 | 53 | 8 | 4 | 0.054 | 0.083 |
| 10 | a-Si type (d) | PAC(1) | Buff (wool) | 70 | 34 | 69 | 17 | 0.39 | 0.022 |
| 11 | Cd-S type (e) | PAC(2) | Buff (wool) | 115 | 59 | 135 | 15 | 0.32 | 0.023 |
| Comparative | | | | | | | | | |

TABLE 1-continued

| | | | | | | | | | |
|---|---|---|---|---|---|---|---|---|---|
| Example | | | | | | | | | |
| 1 | Organic (a) | PAC(2) | No roughening | | | | | 0.023 | 0.006 |
| 2 | Organic (a) | PAC(1) | Buff (wool) | 165 | 86 | 15 | 7 | 0.09 | 0.01 |
| 3 | Organic (b) | PAC(1) | Buff (wool) | 120 | 59 | 242 | 5 | 0.38 | 0.022 |
| 4 | a-Si type (d) | SiO | Brush (rayon) | 25 | 12 | 116 | 9 | 0.052 | 0.009 |

| | | | Characteristics | | | | | | | |
|---|---|---|---|---|---|---|---|---|---|---|
| Exam. No. | Photosens. layer | O.C. layer | Moisture resistance | Image noise by scratch | Image noise by cleaning residue | Filming fusion | Blade wear | Adhesive property | Layer defect | Sens. lower (black thread |
| 1 | Organic (a) | PAC(1) | ∘ | ∘ | ∘ | ∘ | ∘ | ∘ 10 points | ∘ 0% | ∘ |
| 2 | Organic (a) | PAC(1) | ∘ | ∘ | ∘ | ∘ | ∘ | ∘ 10 points | ∘ 0% | ∘ |
| 3 | Organic (a) | PAC(2) | ∘ | ∘ | ∘ | ∘ | ∘ | ∘ 10 points | ∘ 0% | ∘ |
| 4 | Organic (b) | PAC(1) | ∘ | ∘ | ∘ | ∘ | ∘ | ∘ 10 points | ∘ 0% | ∘ |
| 5 | Organic (a) | PAC(2) | ∘ | ∘ | ∘ | ∘ | ∘ | ∘ 8 points | ∘ 0% | ∘ |
| 6 | Organic (b) | PAC(1) | ∘ | ∘ | ∘ | ∘ | ∘ | ∘ 8 points | ∘ 1% | ∘ |
| 7 | Organic (a) | SiO | ∘ | ∘ | ∘ | ∘ | ∘ | ∘ 8 points | ∘ 0% | ∘ |
| 8 | Organic (b) | $Al_2O_3$ | ∘ | ∘ | ∘ | ∘ | ∘ | ∘ 8 points | ∘ 1% | ∘ |
| 10 | a-Si type (d) | PAC(1) | ∘ | ∘ | ∘ | ∘ | ∘ | Δ 6 points | Δ 3% | ∘ |
| 11 | Cd-S type (e) | PAC(2) | ∘ | ∘ | ∘ | ∘ | ∘ | Δ 6 points | ∘ 2% | ∘ |
| Comparative Example | | | | | | | | | | |
| 1 | Organic (a) | PAC(2) | x | ∘ | ∘ | ∘ | ∘ | Δ 6 points | ∘ 0% | x 1.9 |
| 2 | Organic (a) | PAC(1) | ∘ | Δ | x | ∘ | ∘ | ∘10 points | ∘ 0% | ∘ |
| 3 | Organic (b) | PAC(1) | x | ∘ | ∘ | ∘ | ∘ | x 2 points | x 18% | x 1.5 |
| 4 | a-Si type (d) | SiO | ∘ | x | ∘ | x | x | ∘10 points | ∘ 0% | x 1.5 |

(1. No roughening process;
2. Angles are too large;
3. Too large pitch of scratches;
4. Angles are too small)

TABLE 2

| Example No. | Photo-sensitive layer | Resin layer | O.C. layer | Roughening method of photosensitive layer | Shape of scratches and surface roughness θ (°) | α,β (°) | l [μm] | w [μm] | Rt [μm] | Ra [μm] |
|---|---|---|---|---|---|---|---|---|---|---|
| 13 | (a) | (A) | PAC(1) | Buff (wool) | 112 | 61 | 25 | 9 | 0.083 | 0.01 |
| 14 | (b) | (B) | PAC(1) | Buff (wool) | 105 | 54 | 16 | 7 | 0.089 | 0.009 |
| 15 | (a) | (A) | PAC(2) | Buff (wool) | 98 | 47 | 6 | 5 | 0.081 | 0.009 |
| 16 | (a) | (A) | PAC(1) | Buff (wool) | 90 | 42 | 8 | 11 | 0.111 | 0.01 |
| 17 | (b) | (B) | PAC(1) | Brush (rayon) | 125 | 61 | 19 | 15 | 0.128 | 0.011 |
| 18 | (a) | (A) | SiO | Brush (66nylon) | 82 | 41 | 150 | 8 | 0.38 | 0.024 |
| 19 | (a) | (A) | $Al_2O_3$ | Buff (wool) | 64 | 33 | 85 | 9 | 0.194 | 0.009 |
| 20 | (c) | (A) | PAC(1) | Buff (wool) | 129 | 76 | 66 | 14 | 0.097 | 0.013 |
| 21 | (d) | (A) | PAC(1) | Buff (wool) | 68 | 36 | 75 | 12 | 0.085 | 0.01 |
| 22 | (e) | (A) | PAC(2) | Brush (rayon) | 102 | 53 | 120 | 17 | 0.087 | 0.014 |
| Comparative Example | | | | | | | | | | |
| 5 | (a) | (A) | PAC(2) | No roughing | | | | | 0.026 | 0.007 |
| 6 | (a) | (A) | PAC(1) | Buff (wool) | 162 | 83 | 22 | 8 | 0.11 | 0.011 |
| 7 | (b) | (B) | PAC(1) | Buff (wool) | 115 | 58 | 260 | 9 | 0.28 | 0.025 |
| 8 | (a) | (A) | SiO | Brush (rayon) | 24 | 11 | 107 | 10 | 0.085 | 0.01 |

| | Characteristics | | | | | | | |
|---|---|---|---|---|---|---|---|---|
| Exam. No. | Moisture resistance | Image noise by scratches | Image noise by cleaning residue | Filming fusion | Blade wear | Adhesive property | Layer defect | Sensitivity lowering (black threads) |
| 13 | ∘ | ∘ | ∘ | ∘ | ∘ | ∘ 10 points | ∘ 0% | ∘ |
| 14 | ∘ | ∘ | ∘ | ∘ | ∘ | ∘ 10 points | ∘ 0% | ∘ |
| 15 | ∘ | ∘ | ∘ | ∘ | ∘ | ∘ 10 points | ∘ 0% | ∘ |
| 16 | ∘ | ∘ | ∘ | ∘ | ∘ | ∘ 10 points | ∘ 0% | ∘ |
| 17 | ∘ | ∘ | ∘ | ∘ | ∘ | ∘ 8 points | ∘ 0% | ∘ |
| 18 | ∘ | ∘ | ∘ | ∘ | ∘ | ∘ 8 points | ∘ 1% | ∘ |
| 19 | ∘ | ∘ | ∘ | ∘ | ∘ | ∘ 8 points | ∘ 0% | ∘ |
| 20 | ∘ | ∘ | ∘ | ∘ | ∘ | ∘ 8 points | ∘ 1% | ∘ |
| 21 | ∘ | ∘ | ∘ | ∘ | ∘ | ∘ 10 points | ∘ 0% | ∘ |
| 22 | ∘ | ∘ | ∘ | ∘ | ∘ | Δ 8 points | ∘ 1% | ∘ |
| Comparative Example | | | | | | | | |
| 5 | x | ∘ | ∘ | ∘ | ∘ | Δ 6 points | ∘ 0% | x 2.1 |
| 6 | ∘ | Δ | x | ∘ | ∘ | ∘ 10 points | ∘ 0% | ∘ |
| 7 | x | ∘ | ∘ | ∘ | ∘ | x 2 points | x 18% | x 1.8 |

TABLE 2-continued

| | | | | | | | | |
|---|---|---|---|---|---|---|---|---|
| 8 | ∘ | x | ∘ | x | x | ∘ 10 points | ∘ 0% | x 1.5 |

(1. No roughening process;
2. Angles are too large;
3. Too large pitch of scratches;
4. Angles are too small)

Preparation of a photosensitive layer, a method of surface roughing, preparation of a vacuum thin layer and a method of evaluation are explained concretely as follows.

Preparation of an Organic Photosensitive Layer (a) (the separated function type for negative chargeability)

A mixture of 1 part by weight of chlorodianblue (CDB)(a bisazo pigment), 1 part by weight of a polyester resin (made by Toyobo K.K.; V-200) and 100 parts by weight of cyclohexanone was dispersed for 13 hours by using a sand grinder. This dispersion was applied on a cylindrical aluminum substrate (80 mm in diameter×330 in length), by a dipping method and dried to form a charge-generating layer of 0.3 μm thickness.

Then, 1 part by weight of 4- diethylaminobenzaldehyde-diphenylhydrazone (DEH) and 1 part by weight of a polycarbonate (made by Teijin Kasei K.K., K-1300), were dissolved in tetrahydrofuran (THF) of 6 parts by weight. This solution was applied onto the above charge-generating layer and dried to form a charge-transporting layer of 15 μm thickness after dried. Thus, an organic photosensitive layer (a) was obtained.

Preparation of an Organic Photosensitive Layer (b) (binder-type for positive chargeability)

A mixture of 25 parts by weight of a special α type pigment of phthalocyanine (made by Toyo Ink K.K.), 50 parts by weight of thermosetting acrylmelamine resin (made by Dainippon Ink K.K.; a mixture of A-405 and Super Beckamine J820), 25 parts by weight of 4-diethylaminobenzaldehyde-diphenylhydrazone and 500 parts by weight of an organic solvent (a mixture of 7 parts by weight of xylene and 3 parts by weight of butanol) was pulverized and dispersed in a ball mill for 10 hours. This dispersed solution was applied onto a cylindrical aluminum substrate (80 mm in diameter×330 mm in length by a dipping technique, dried and baked at 150° C. for 1 hour) to obtain an organic photosensitive layer (b) of 15 μm thickness.

Preparation of a Selenium-type Photosensitive Layer (c)

Figure 12:
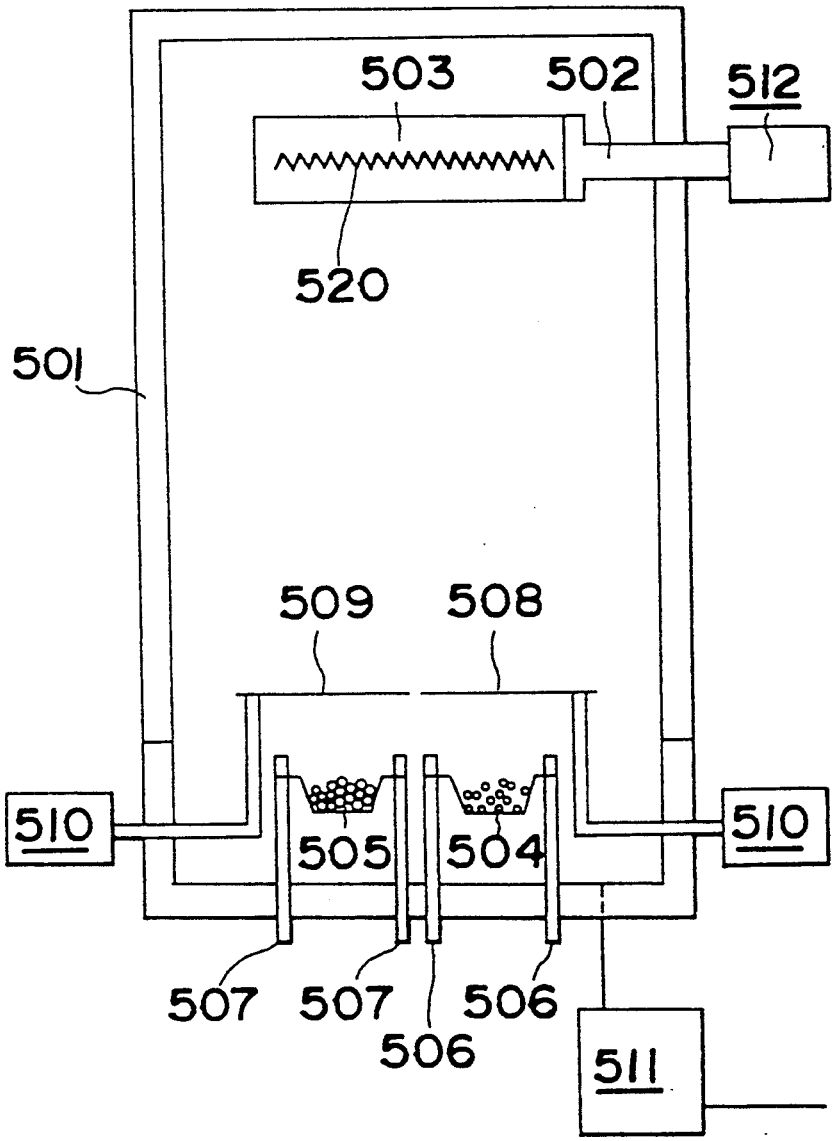
FIG. 12 is a diagram showing an example of outline of the construction of a vapor deposition apparatus.

By using a vapor deposition apparatus shown in FIG. 12, the ordinary method of vapor deposition by resistance heating was applied to obtain a Se-As photosensitive layer (c) of about 50 μm thickness, which was comprised of a single layer of per se known selenium-arsenic alloy.

Preparation of a Amorphous Silicon-type Photosensitive Layer (d)

Step (1)

Figure 11:
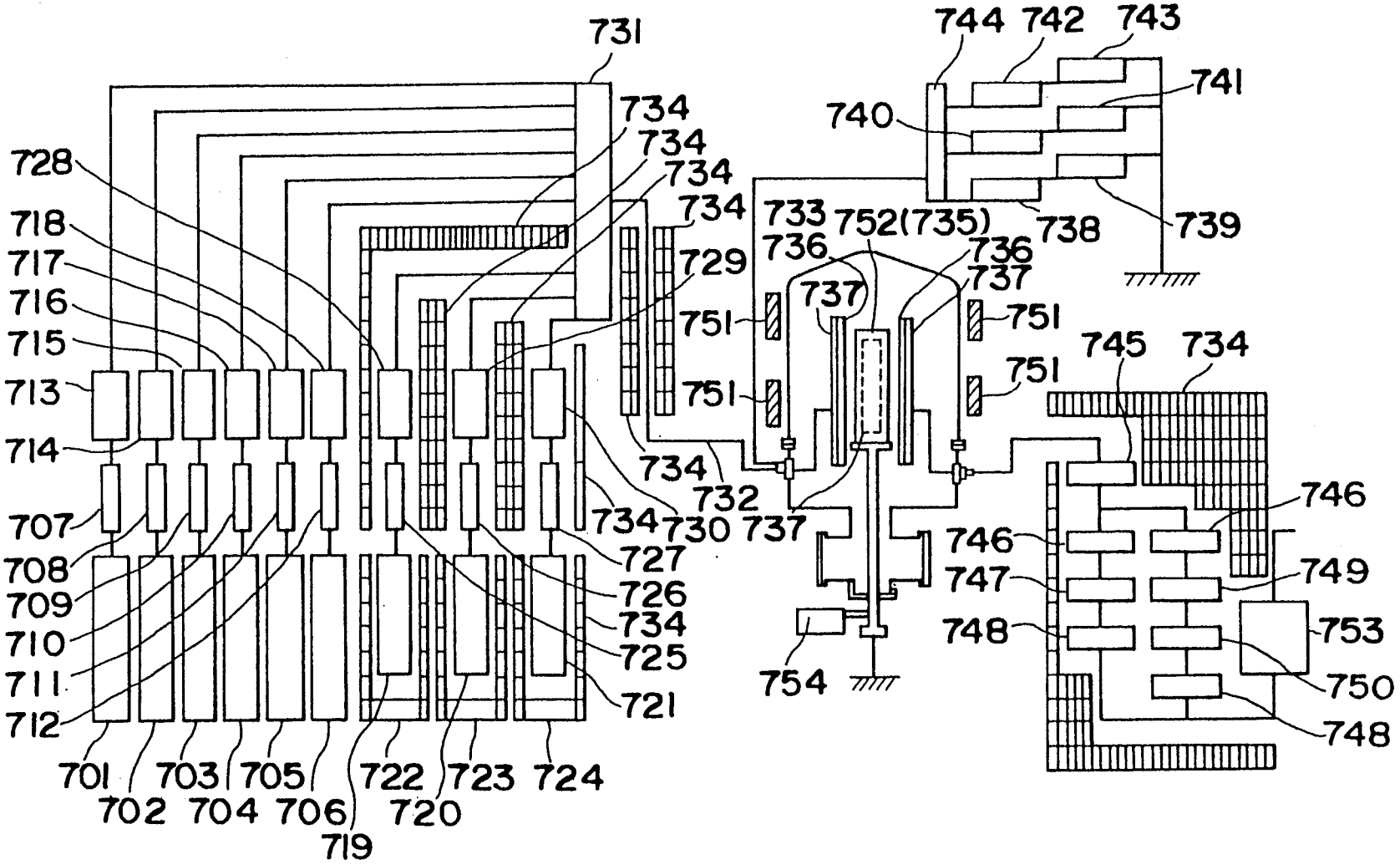
FIG. 11 is a diagram to show an example of outline of the construction of a glow discharge decomposition apparatus.

In a glow discharge decomposition apparatus as shown in FIG. 11, the inner room of a reactor (733) was evacuated to so high a vacuum as about $10^{-4}$ Torr and then control valves Nos. 1 to 3 and No. 5 (707), (708), (709) and (711) were respectively opened so as to make $H_2$ gas from No. 1 tank (701), 100% $SiH_4$ gas from No. 2 tank (702), $B_2H_4$ gas diluted to 200 ppm with $H_2$ gas from No. 3 tank (703) and $C_2H_4$ gas from No. 5 tank (705) to flow into the respective mass flow controllers (713), (714), (715) and (717) under 1 kg/cm$_2$ in pressure gauge. The mass flow controllers were adjusted so as to make the flow rate of $H_2$ gas 300 sccm, $SiH_4$ gas 90 sccm, $B_2H_4$ (as 200 ppm/$H_2$) 100 sccm and $C_2H_4$ 120 sccm and these gases were flowed into the reactor (733). After the flow rates of these gases were stabilized, the inner pressure of the reactor (733) was adjusted to be 1.0 Torr. On the other hand, a cylindrical aluminum (80 mm in diameter×300 mm length), was employed as a substrate (752) and heated previously to 250° C. After the flow rates of gases and the inner pressure of the reactor were stabilized, a high frequency power source (739) was placed and a power of 200W (frequency: 13.56 MHz) was applied to an electrode plate (736) for generation of glow discharge. The discharge was maintained for 3.5 minutes for the formation of a first layer of about 0.35 μm thickness containing hydrogen and boron on the electrically conductive substrate (752).

Step (2)

After the first layer was formed, without stopping the power application from the high frequency power source, the control valve (711) was closed to make the flow rate of $C_2H_4$ in the mass flow controller (717) zero within 30 seconds. By following then Step (1) under similar other conditions, a second layer of 0.05 μm thickness was obtained.

Step (3)

After the formation of the second layer, the power application from the high frequency power source was stopped and the flow rates in the mass controllers were made zero and the inner room of the reactor (733) was sufficiently evacuated. Then, $H_2$ gas at 400 sccm was allowed to flow into the reactor from No. 1 tank (701), 100% $SiH_4$ gas at 200 sccm from No. 2 tank 702), $B_2H_4$ gas diluted with $H_2$ gas to 200 ppm at 200 sccm from No. 3 tank and $O_2$ gas at 2 sccm from No. 6 tank. After the inner pressure was adjusted to 1.0 Torr, the switch of the high frequency power source was put on to apply a power of 300W. Discharging was continued for about 4 hours to obtain a third layer of about 28 μm thickness, and thus an amorphous silicone photosensitive layer (d) was finally formed on the cylindrical aluminum substrate.

Preparation of Cadmium Sulfide/resin-dispersed Photosensitive Layer (e)

A photoconductive particle of $CdS{\cdot}nCdCO_3$ ($0<n\leqq 4$) was dispersed together with a thermosetting acryl resin. The dispersion was applied onto a cylindrical aluminum substrate to about 30 μm thickness before it was hardened by heating to prepare a cadmium sulfide/resin-dispersed photosensitive layer.

Preparation of a Photosensitive Layer having a Resin Layer thereon

Formation of Resin Layer (A)

One part by weight of a polycarbonate (made by Teijin Kasei K.K.; K-1300) was dissolved in 10 parts by weight of THF and the solution was applied onto a photosensitive layer so that a resin layer of 0.06 μm thickness might be obtained after dried.

Formation of Resin Layer (B)

A thermosetting acrylmelamine resin was dissolved in an organic solvent (a mixture of 7 parts by weight of xylene and 3 parts by weight of butanol) and the solution was applied onto a photosensitive layer so that a resin layer of 0.06 μm thickness might be obtained after dried and baked.

ROUGHENING OF PHOTOSENSITIVE MEMBER

Examples 1 to 4, 7 to 11, 13 to 16 and 19 to 21 and Comparative Examples 2, 3, 6 and 7

Figure 9:
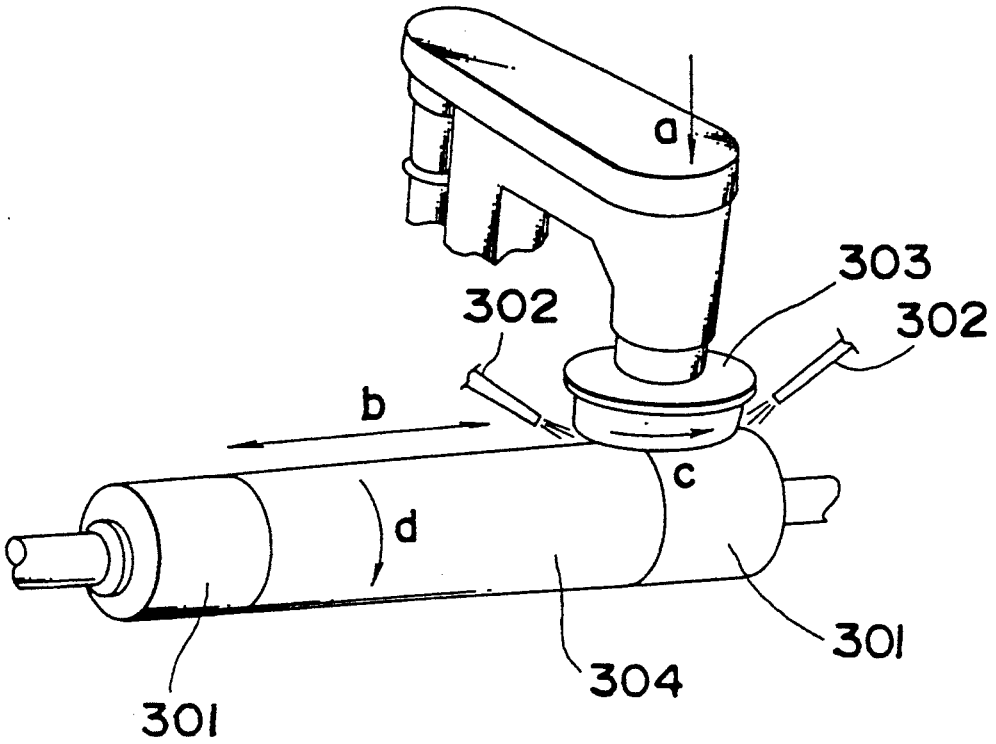
FIG. 9 is a view schematically depicting a method of buff abrasion.
Figure 10:
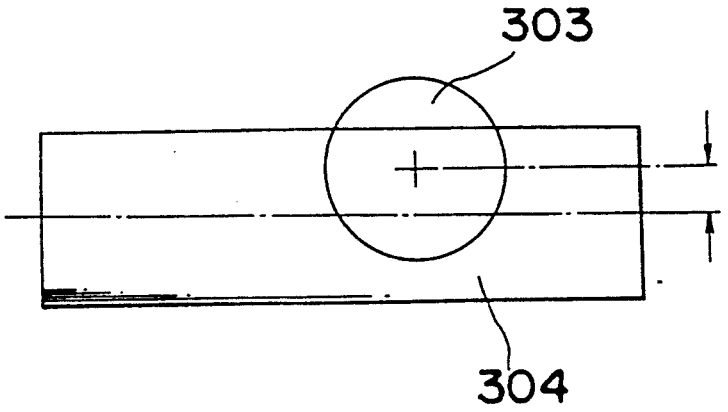
FIG. 10 is a view for explaining a buff deviation.

The surface of the photosensitive layers obtained as above was roughened by a buff abrasion apparatus as shown in FIGS. 9 and 10 under the conditions specified in Table 3.

TABLE 3

| Example & Comparative Example No. | Buff deviation [cm] (L) | Work rotation [rpm] | Buff rotation [rpm] | Buff load [kg] | Buff feed [cm/min] | Abrasive Material | Abrasive Particle size [μm] | Abrasive Amount [g/l] |
|---|---|---|---|---|---|---|---|---|
| Example 1 | 5 | 200 | 350 | 4 | 1 | Alumina | 2 | 2.5 |
| Example 2 | 6 | 300 | 500 | 4 | 1 | Alumina | 2 | 2.5 |
| Example 3 | 6 | 300 | 500 | 4 | 1 | Alumina | 2 | 2.5 |
| Example 4 | 5 | 300 | 500 | 4 | 1 | Alumina | 3 | 5 |
| Example 7 | 6 | 120 | 800 | 5 | 1.5 | SiO | 4 | 5 |
| Example 8 | 4.5 | 300 | 300 | 4 | 1.5 | SiO | 2 | 2.5 |
| Example 9 | 5 | 200 | 500 | 3 | 1.5 | Alumina | 1.2 | 5 |
| Example 10 | 7 | 100 | 850 | 6 | 1 | SiC | 5 | 5 |
| Example 11 | 6 | 300 | 350 | 6 | 1 | SiO | 5 | 2 |
| Example 13 | 6 | 300 | 350 | 4 | 1.5 | Alumina | 2 | 2 |
| Example 14 | 6 | 200 | 500 | 4 | 1 | Alumina | 2 | 2 |
| Example 15 | 5 | 200 | 500 | 4 | 1.5 | Alumina | 2 | 2 |
| Example 16 | 5 | 200 | 500 | 4 | 1.5 | Alumina | 2 | 2 |
| Example 19 | 7 | 120 | 800 | 5 | 1 | Alumina | 4 | 2 |
| Example 20 | 4.5 | 300 | 300 | 4 | 1 | SiO | 2 | 5 |
| Example 21 | 7 | 100 | 850 | 4 | 1.5 | Alumina | 2 | 5 |
| Comp. Example 2 | 3.5 | 350 | 60 | 4 | 1 | Alumina | 2 | 2 |
| Comp. Example 3 | 6 | 120 | 60 | 5.3 | 1 | SiO | 5 | 5 |
| Comp. Example 6 | 3.5 | 350 | 60 | 4 | 1 | Alumina | 3 | 2 |
| Comp. Example 7 | 6 | 120 | 60 | 5.3 | 1.5 | Alumina | 4 | 2 |

The photosensitive member was fixed by a chucking (301) and a disc buff of wool felt (20 cm in diameter) (303) was set to the position of the definite buff deviation. Buff deviation (L) means the distance between the center line of the photosensitive member (304) in the longitudinal direction and the center point of the disc buff (303) as shown in FIG. 10.

Then, as shown in FIG. 9, the photosensitive member (304) was rotated in the direction of arrow (d) (work rotation), and while the disc buff was rotated in the direction of arrow (c), a load (buff load) was applied onto the disc buff (303) from the direction of arrow (a) so as to compress the disc buff (303) to the photosensitive member (304) and to make the buff engaged in a reciprocating motion (buff feed) in the direction of arrow (b). In timing with the motion of the buff, pure water containing or not containing a dispersed abrasive was delivered at a rate of 1 l/min toward the contact surface of the photosensitive member and disc buff through the delivering nozzle (302).

Examples 5, 6, 17, 18 and 22 and Comparative Examples 4 and 8

The cylindrical brushes having 5 cm in diameter were installed in non-parallel state to each other as shown in FIG. 5 (at angle 120° in Examples 5 and 17, 100° in Example 22, 80° in Examples 6 and 18, and 30° in Comparative Examples 4 and 8). While the photosensitive member was rotated at a speed of 120 rpm, the brush rollers were rotated at 450 rpm under press against to the photosensitive member. The brushes were made to move at the speed of 1 cm/second in the direction parallel to the axis of the photosensitive member so as to roughen the surface of the member.

The above buff or brush abrasion was carried out for about 2 minutes before completion of the roughening process of the surface of the photosensitive member.

After the roughening process, the photosensitive member was subjected to ultrasonic washing in pure water, and further washing in pure water at 60° C. After washing, the photosensitive member was pulled up from water into a dry air atmosphere at a speed of about 1 cm/second for drying.

The degree of the roughness on the surface of the photosensitive member was expressed in terms of the maximum height (Rt) and the center line mean roughness (Ra). For the determination, an apparatus for determining surface roughness and shape, Surfcom 550A (trade name, made by Tokyo Seimitsusha K.K.) was employed.

Finally, on the photosensitive member with the roughened surface as described above a surface protective layer was formed by the steps described below.

Preparation of Plasma Amorphous Hydrocarbon Layer (1) (referred to as PAC (1))

In the glow discharge decomposition apparatus shown in FIG. 11, the inner room of the reactor (733) was evacuated to so high a vacuum as $10^{-4}$ Torr and then the control valves No. 1, 2 and 3 (707, 708 and 709, respectively) were opened to allow hydrogen gas from No. 1 tank (701) to flow into the mass flow controller No. 1 (713), butadiene gas from No. 2 tank (702) into the mass flow controller No. 2 (714) and tetrafluoromethane gas from No. 3 tank (703) into the mass flow controller No. 3 (715), all at an output pressure of 1.5 kg/cm. By controlling the controllers, the flow rate of hydrogen gas was set to 300 sccm, butadiene gas to 15 sccm and tetrafluoromethane gas to 90 sccm and these gases were flowed into the reactor (733) through the main pipe (732) via the mixer (731) on the way. After the flow rates of gases were stabilized, the pressure adjusting valve (745) was adjusted to make the inner pressure of the reactor (733) to be 0.5 Torr. As a substrate (752) on which the photosensitive layer was formed as described above was employed.

Then, the substrate (752) was fixed to the grounding electrode (735) in the reactor (733). The substrate had been heated to 50° C. for about 15 minutes. Under the conditions of stabilized gas flow rates and inner pressure, a switch of a low frequency power source (741) which had previously been connected to a connection selecting switch was put on and a power of 150W was applied at the frequency of 80 KHz to the electrode (736) for conducting plasma polymerization for about 2 minutes to prepare an amorphous hydrocarbon layer of 0.1 μm thickness on the substrate (752).

After the layer formation was completed, the power supply was stopped and all control valves except for the valve for hydrogen gas were closed allowing only hydrogen gas to flow into the reactor (733) at the flow rate of 100 sccm. While the pressure was kept at 1 Torr, the temperature was lowered to about 30° C. Then, the valve for hydrogen gas (707) was closed. After sufficient evacuation of the reactor (733), the vacuum in the reactor was broken. Thus, a photosensitive member of the present invention was obtained.

Preparation of the Plasma Amorphous Hydrocarbon Layer (2) (referred to as PAC (2))

In the glow discharge decomposition apparatus shown in FIG. 11, the inner room of the reactor (733) was evacuated to so high a vacuum as $10^{-4}$ Torr and the control valves No. 1 and No. 2 (707 and 708, respectively) were opened to allow hydrogen gas from No. 1 tank (701) and butadiene gas from No. 2 tank (702) to flow into the mass flow controllers No. 1 (713) and No. 2 (714), respectively. The mass flow controllers were controlled so as to make the flow rate of hydrogen gas 300 sccm and that of butadiene gas 15 sccm, and both gases were flowed into the reactor (733) through the main pipe (732) via the mixer (731) on the way. After the flow rates of these gases were stabilized, the pressure adjusting valve (745) was used to adjust the pressure in the inner room of the reactor (733) to 1.0 Torr. On the other hand, the drum on which the above described organic photosensitive layer was formed was employed as a substrate (752).

Then, the substrate (752) was fixed to the grounding electrode (735) in the reactor (733). The substrate (752) was heated to 50° C. from room temperature over a period of about 15 minutes before the gases were input. Under the conditions of stabilized gas flow rates and pressure, the switch of low frequency power source (741) which had previously been connected to the connection selecting switch (744) was put on and 150W of electric power was applied at a frequency of 80 KHz to carry out plasma polymerization for about 3.5 minutes, and an amorphous hydrocarbon layer was formed to have 0.1 μm thickness on the substrate (752).

After the completion of the layer formation, the controlling valves except for hydrogen gas were closed allowing only hydrogen gas to flow into the reactor (733) at the flow rate of 100 sccm. While the pressure was kept at 1 Torr, the temperature was allowed to fall to about 30° C. Then the valve for hydrogen gas (707) was closed, the inner room of the reactor (733) was sufficiently evacuated and the vacuum within it was destroyed to obtain a photosensitive member in the present invention.

Preparation of Aluminum Oxide Layer (referred to as $Al_2O_3$) layer)

By a technique of high frequency (13.56 MHz) spattering, a surface protective layer was formed on an organic photosensitive layer. The organic photosensitive layer described above was fixed to a grounding electrode in a vacuum chamber in an apparatus for vapor deposition by high frequency spattering (no diagram is shown). The opposite electrode for high frequency power application was covered by an aluminum oxide $Al_2O_3$ plate of about 5 mm thickness, and this was made the target.

The vacuum chamber was evacuated by using an exhaust pump to so high a vacuum as $10^{-7}$ Torr and argon gas for spattering was allowed to flow into the vacuum chamber and the pressure was set to $5\times10^{-2}$ Torr. Then 200W of power was applied to the electrode at 13.56 MHz to carry out spattering for about 10 minutes, so that a surface protective layer of 0.1 μm thickness, which was comprised of $Al_2O_3$ over the base plate was obtained. After the layer was formed, the application of power was discontinued and the vacuum chamber was evacuated before vacuum therein was broken, and a photosensitive member having a surface protective layer of the present invention was taken out.

Preparation of Silicon Oxide Layer (referred to as SiO Layer)

Using a vapor deposition apparatus shown in FIG. 12, a surface protective layer was formed. As a base plate (503), the substrate on which the organic photosensitive layer was formed as described above was used. This base plate (503) was fixed to a base plate supporter (502). A silicon oxide SiO powder was placed in a boat (504).

Then, after evacuation of a vacuum chamber (501) by using an exhaust pump (511) to so high a vacuum as about $10^{-7}$ Torr, a power was applied to an electrode (506). The temperature of the boat (504) was raised to 1080° C. After the temperature of the boat (504) was stabilized, a motor (512) was started and during rotation of the base plate (503) at a speed of about 10 rpm, a shutter (508) which had been kept in closed state was changed to open state by the operation of the rotation leading terminal for about 3 minutes for performing vapor deposition under a vacuum of about $10^{-5}$ Torr, and a surface protective layer, about 0.15 μm thick, which was comprised of SiO was formed on the base plate (503).

After the surface protective layer was formed, the power supply to the electrode (506) was discontinued and at the same time the vacuum chamber was extensively exhausted and the vacuum in the chamber was destroyed to obtain a photosensitive member having a surface protective layer of the present invention.

Evaluation of the characteristics was done on the photosensitive members obtained in the Examples and Comparative Examples in the following properties.

The photosensitive members of the negative chargeable-type (a) and (e) were installed into a copying machine (EP5400; made by Minolta K.K.) while those of the positive chargeable-type (b), (c) and (d) in a machine (EP550Z; made by Minolta K.K.).

Moisture Resistance

After the repetition of 100,000 times of copying process in ordinary room environment, the copying was done at temperature 35° C. and relative humidity 85% and the image flows were observed visually to evaluate to the following ranks.

0: No image flow and judged as satisfactory

×:In character images, flows were observed so that some characteristics could not be read distinctly

Image Noise (Scratches)

To test the influence of the scratches on the surface of photosensitive members on copied images, the copying process was repeated 1,000 times and after the adjustment of exposure, half-tone copied images of 0.50 image density were obtained. The thread-like noises in the copied images were observed visually and their correspondence to the scratches on the surface of the photosensitive members was studied for making the following ranks.

0: No noises corresponding to the surface scratches observed and judged as satisfactory Δ: Noises slightly observed corresponding to the surface scratches but no problem in practical use ×: Inadequate for practical use

Image Noise (Cleaning Residue)

To examine the influence of insufficient cleaning on copied images, the copying process was repeated 10,000 times and a blank original was copied to obtain blank copies. The noise due to cleaning residue was observed visually for making the following ranks:

0: No cleaning residue observed and judged as satisfactory

×: Cleaning residue found and inadequate for practical use

Filming Fusion

Filming fusion of toner particles was examined after the repetition of 100,000 times of copying process in the ordinary room environment by taking out the photosensitive member from the copying machine and looking for filming fusion on its surface and the following ranks wore made from the results.

0: No filming fusion on the surface of the photosensitive member was found and copied images were satisfactory ×: Filming fusion was found on the photosensitive member

Blade Wear

Blade wear was examined after the repetition of 10,000 times of copying process in the ordinary room environment by taking out the cleaning blade from the copying machine and observing the amount of wear on the part of the blade in contact with the photosensitive member under optical microscope and the following ranks were made from the results.

0: The amount of wear is within 100 μm from the top end and the wear is homogeneous ×: Irregularly worn and in extreme cases the amount exceeds 100 μm from the top end

Evaluation of Layer Defects

After the repetition of 10,000 times of copying, the surface of the photosensitive member was observed under an optical microscope (300 magnification) (area of visual field: 0.08 $mm^2$) and the image was analyzed by an image-analyzing apparatus, LUZEX 5000 (trade name, made by Nireco K.K.) to calculate the rate of the area of the defected parts on the surface of the surface protective layer. The observation was done on 20 randomly taken points and among the observed values the maximum one was taken as the result.

The rate of layer defect was ranked as follows:

| Rate of defect | Symbol | Evaluation |
|---|---|---|
| 0~2% | 0 | Satisfactory |
| More than 2% ~ 5% | Δ | No problem in practical use |
| More than 5% ~ | x | Inadequate for practical use |

Evaluation of Adhesive Property

The cross-cut adhesion test according to the specification of JIS-K5400 was carried out for the evaluation of adhesive property of the surface protective layer to the organic photosensitive member and the following ranking was made.

| Rated point in the cross-cut adhesion test | Symbol | Evaluation |
|---|---|---|
| 10~8 points | 0 | Sufficient strength in layer adhesion |
| 6~4 points | Δ | Insufficient strength in layer adhesion but no problem in practical use |
| Less than 2 points | x | Insufficient strength in layer adhesion. Inadequate in use |

Evaluation of Sensitivity Lowering

The experimentally prepared photosensitive members were installed into an copying machine and half-tone copied images with image density of 0.50 were obtained by adjusting exposure.

Then after taking 10,000 A4 size copies, half-tone images were obtained by the same exposure and the image densities were determined to see the difference from the initial image density of 0.50.

For example, when the image density after taking 10,000 copies was 0.55, the difference of 0.05 was the degree of the sensitivity lowering.

The surface potential of the copying machine was set at 600 [V] and the developing bias at 150 [V].

In the table of Examples evaluation of sensitivity lowering was shown according to the evaluation criterion as shown below.

Image density was determined by using a densitometer, Sakura-densitometer PDA65 (trade name, made by Konica K.K.).

| Difference in image density | Symbol | Evaluation |
|---|---|---|
| Less than 0.1 | 0 | No sensitivity lowering observed and evaluated as satisfactory |
| More than 0.1 ~ less than 0.2 | Δ | Some sensitivity lowering observed but no problem in practical use |
| More than 0.2 | x | Sensitivity lowering observed and evaluated as not preferable |

The photosensitive members in Examples 1 through 22 showed satisfactory moisture resistance after long usage and had no problem in practical use. The members in Examples 1 and 15 did not show any image flows even after the repetition of 600,000 times of copying under either ordinary atmosphere or highly humid atmosphere.

As shown in Comparative Examples 1 and 5, the photosensitive members on which a vacuum thin layer was directly formed without the roughening process showed no problems in regard to copied image noises, but after the repetition of 100,000 times of copying process, copied images taken under highly humid environment (35° C., 85%) showed image-flows.

The photosensitive members as those in Comparative Examples 2 and 6 in which the angles of scratches were too large did not show flows in copied images taken under highly humid conditions after the repetition of 100,000 times of copying process, but the copies showed image noises corresponding to abrasion scratches and they were not adequate for practical use.

In the case, as in Comparative Examples 3 and 7, where the surface was too rough and the scratches had too high pitches, problem arose in reference to the adhesive property of the vacuum thin layer, and after 100,000 times of copy, image flows were observed in copied images taken under highly humid conditions and the photosensitive members were not adequate for practical use.

The photosensitive members as those in Comparative Examples 4 and 8 in which the angles of scratches were too small showed flows in copied images taken under highly humid conditions after 100,000 times of copy, but image noises corresponding to abrasion scratches developed and in addition filming and fusion of toner took place and blade wear was also distinct. These results showed that they were not adequate for practical use.

Furthermore, lowering of sensitivity was examined on the photosensitive members having organic photosensitive layer and those members having resin layer over the photosensitive layer in the present invention to find that when the pitch l was less than 30 μm the sensitivity lowering was not observed at all or the lowering was so little that it did not bring about problem in practical use.

Explanation of the present invention by Examples continues further as follows.

Figure 18:
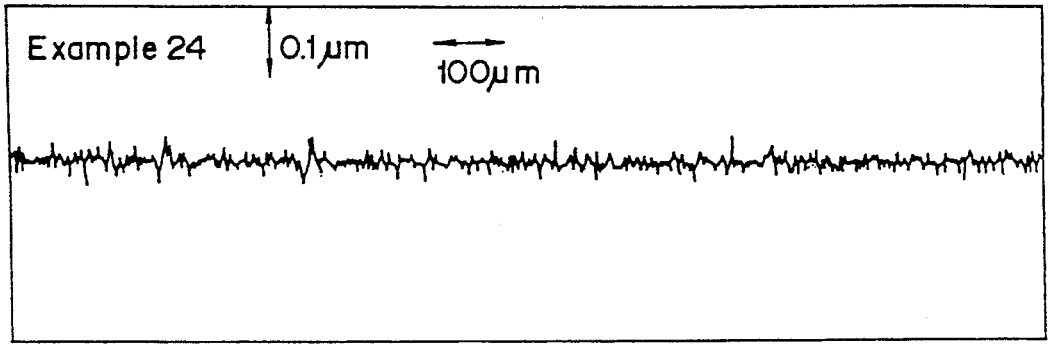
FIGS. 18 to 21 are diagrams showing a roughness curve on the surface of a photosensitive member.
Figure 19:
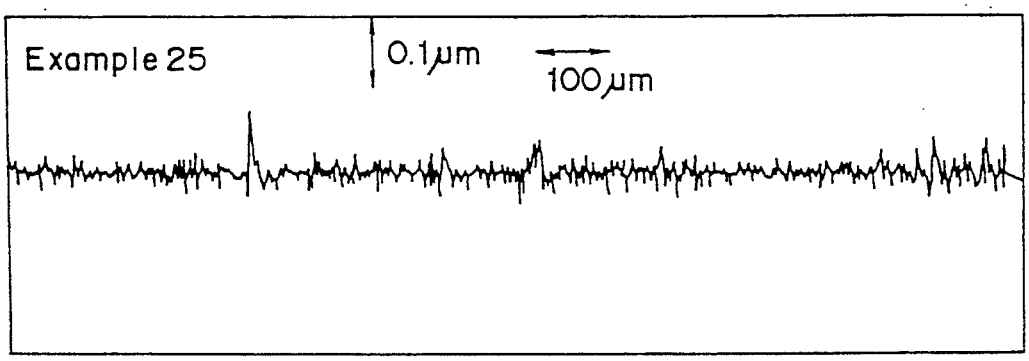
Figure 20:
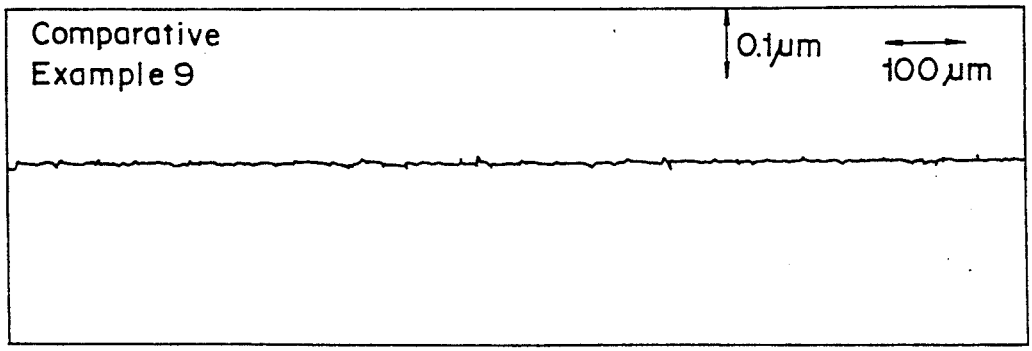
Figure 21:
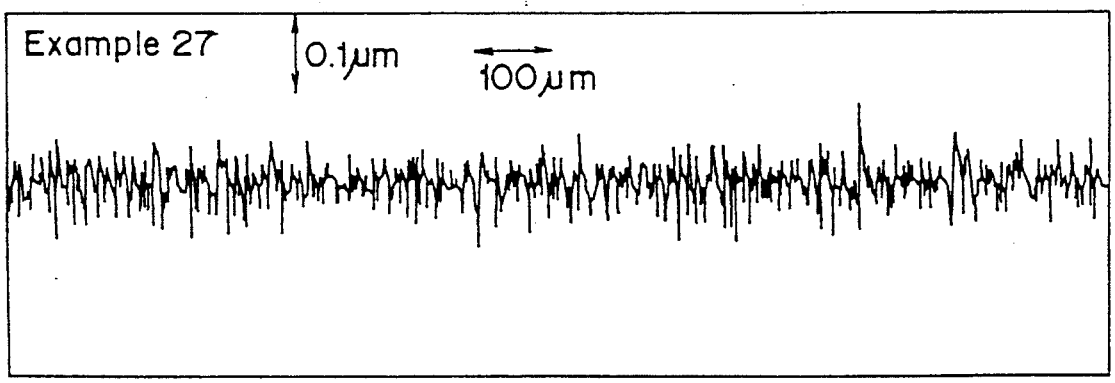

Photosensitive members were prepared in the combinations of an organic photosensitive layer, a roughening process of a photosensitive layer and a surface protective layer as described below and summarized in Table 4. The surface roughness (Rt, Rz, Ra, RMS and Sm) of the photosensitive member and results of evaluation (adhesive property, layer defect and sensitivity lowering) were also included in Table 4. The roughness curve of the surface of the photosensitive member obtained in Example 24 is shown in FIG. 18, that in Example 25 in FIG. 19, that in Example 27 in FIG. 21 and that in Comparative Example 9 in FIG. 20 (determining apparatus:Surfcom 550A (trade name, made by Tokyo Seimitsu K.K.).

| Exam. No. | Photo-sens. layer | S.P. layer | Roughening method of photosensitive layer | Surface roughness Rt [μm] | Rz [μm] | Ra [μm] | RMS [μm] | Sm [μm] | Evaluation Adhes. prop. | Layer defect | Sens. low |
|---|---|---|---|---|---|---|---|---|---|---|---|
| 23 | (a) | PAC(2) | Buff (wool) | 0.086 | 0.075 | 0.01 | 0.013 | 12 | ∘ 10 points | ∘ 0% | ∘ 0.05 |
| 24 | (a) | PAC(2) | Buff (wool) | 0.079 | 0.063 | 0.01 | 0.013 | 8 | ∘ 10 points | ∘ 0% | ∘ 0.06 |
| 25 | (a) | PAC(1) | Buff (wool) | 0.13 | 0.108 | 0.012 | 0.015 | 10 | ∘ 10 points | ∘ 0% | ∘ 0.05 |
| 26 | (a) | PAC(1) | Buff (wool) | 0.111 | 0.1 | 0.01 | 0.012 | 8 | ∘ 10 points | ∘ 0% | ∘ 0.03 |
| 27 | (a) | SiO | Buff (wool) | 0.194 | 0.161 | 0.018 | 0.026 | 6 | ∘ 8 points | ∘ 0% | ∘ 0.05 |
| 28 | (a) | $Al_2O_3$ | Buff (wool) | 0.069 | 0.056 | 0.009 | 0.01 | 7 | ∘ 8 points | ∘ 1% | ∘ 0.03 |
| 29 | (b) | PAC(2) | Buff (wool) | 0.055 | 0.048 | 0.0083 | 0.009 | 28 | ∘ 10 points | ∘ 0% | Δ 0.15 |
| 30 | (a) | PAC(2) | Buff (wool) | 0.39 | 0.32 | 0.022 | 0.032 | 10 | Δ 6 points | Δ 3% | ∘ 0.02 |
| 31 | (b) | PAC(1) | Buff (wool) | 0.35 | 0.3 | 0.023 | 0.03 | 18 | Δ 6 points | ∘ 2% | ∘ 0.05 |
| 32 | (b) | SiO | Buff (wool) | 0.118 | 0.108 | 0.012 | 0.015 | 8 | ∘ 10 points | ∘ 1% | ∘ 0.05 |
| 33 | (a) | PAC(2) | Brush (nylon) | 0.19 | 0.176 | 0.01 | 0.016 | 9 | ∘ 10 points | ∘ 0% | ∘ 0.02 |
| 34 | (b) | PAC(1) | Brush (nylon) | 0.13 | 0.113 | 0.014 | 0.018 | 11 | ∘ 8 points | ∘ 2% | ∘ 0.03 |
| 35 | (a) | PAC(2) | Brush (rayon) | 0.1 | 0.089 | 0.015 | 0.017 | 8 | ∘ 8 points | ∘ 1% | ∘ 0.05 |
| 36 | (b) | PAC(1) | Brush (rabbit hair) | 0.124 | 0.112 | 0.009 | 0.012 | 6 | ∘ 10 points | ∘ 0% | ∘ 0.03 |
| 37 | (a) | PAC(2) | Sand blast (0.7 μm SiC particle) | 0.364 | 0.29 | 0.017 | 0.019 | 10 | ∘ 8 points | ∘ 2% | ∘ 0.03 |
| 38 | (b) | PAC(1) | | 0.38 | 0.35 | 0.021 | 0.025 | 15 | Δ 6 | Δ | ∘ |

-continued

| | | | | | | | | | | | |
|---|---|---|---|---|---|---|---|---|---|---|---|
| | | | | | | | | | points | 4% | 0.05 |
| Comp. Exam. No. | Photo-sens. layer | S.P. layer | Roughening method of photosensitive layer | Surface roughness Rt [μm] | Rz [μm] | Ra [μm] | RMS [μm] | Sm [μm] | Evaluation Adhes. prop. | Layer defect | Sens. low |
| 9 | (a) | PAC(2) | No roughening | 0.027 | 0.025 | 0.007 | 0.008 | 62 | Δ 6 points | ∘ 0% | x 1.5 |
| 10 | (b) | PAC(1) | No roughening | 0.023 | 0.023 | 0.006 | 0.007 | 125 | Δ 6 points | ∘ 0% | x 1.8 |
| 11 | (a) | PAC(2) | Buff (wool) | 0.653 | 0.595 | 0.043 | 0.062 | 22 | x 0 points | x 28% | Δ 0.18 |
| 12 | (b) | PAC(1) | Buff (wool) | 0.553 | 0.42 | 0.029 | 0.045 | 15 | x 2 points | x 18% | ∘ 0.05 |
| 13 | (b) | PAC(1) | Buff (wool) | 0.583 | 0.47 | 0.034 | 0.052 | 25 | x 2 points | x 22% | ∘ 0.04 |
| 14 | (a) | PAC(2) | Sand blast (2 μm SiC particle) | 0.785 | 0.77 | 0.056 | 0.105 | 54 | x 2 points | x 29% | Δ 0.16 |

Exam. No.: Example number;
Photosens. layer: Photosensitive layer;
S.P.: Surface protective;
Adhes. Prop.: Adhesive property;
Sens. low.: Sensitivity lowering Below are described concretely preparation of photosensitive layer, method of roughing surface, preparation of vacuum thin layer and method of evaluation in the Table 4.

Preparation of the Organic Photosensitive Layers (a) and (b)

These photosensitive layers are as same as the ones as described previously in this specification.

Roughening of Organic Photosensitive Layer

Examples 23 to 32

The surface of the photosensitive layers (a) and (b) was roughed by using the buff abrading machine shown in FIG. 9 under the conditions specified in Table 5.

blasted to the photosensitive layer. Then ultrasonic washing was applied in pure water by lightly pressing cloth against the rotating photosensitive member to remove SiC particles remaining and adhering on the surface of the photosensitive layer, and finally the photosensitive drum was dipped for about 1 minute in pure water at 60° C. and dried by pulling up into an atmosphere of dry air at a speed of about 1 cm/second.

Comparative Examples 9 and 10

No roughening process was applied onto the organic photosensitive members.

Comparative Examples 11 to 13

The surface of the photosensitive layers were rough-

TABLE 5

| Example & Comp. Example No. | Buff deviation (L) [cm] | Work rotation [rpm] | Buff rotation [rpm] | Buff load [kg] | Buff feed [cm/min] | Abrasive Material | Particle size [μm] | Amount [g/l] |
|---|---|---|---|---|---|---|---|---|
| Example 23 | 6 | 150 | 500 | 4 | 1 | Alumina | 2 | 2.5 |
| Example 24 | 6 | 150 | 500 | 4 | 1 | Alumina | 2 | 2.5 |
| Example 25 | 5 | 200 | 500 | 4 | 1 | Alumina | 3 | 2.5 |
| Example 26 | 5 | 300 | 500 | 4 | 1 | Alumina | 3 | 2.5 |
| Example 27 | 6 | 200 | 850 | 4 | 1.5 | Alumina | 4 | 2.5 |
| Example 28 | 5 | 200 | 500 | 4 | 1.5 | SiO | 2 | 5 |
| Example 29 | 5 | 150 | 500 | 3 | 1 | SiO | 2 | 5 |
| Example 30 | 6 | 200 | 850 | 4 | 1 | SiC | 6 | 5 |
| Example 31 | 6 | 200 | 850 | 4 | 1 | SiC | 5 | 5 |
| Example 32 | 5 | 200 | 850 | 4 | 1 | SiC | 3 | 5 |
| Comp. Exam. 11 | 6 | 300 | 1200 | 15 | 1.5 | Alumina | 8 | 2.5 |
| Comp. Exam. 12 | 6 | 300 | 1200 | 8 | 1 | SiC | 8 | 5 |
| Comp. Exam. 13 | 6 | 300 | 1200 | 10 | 1 | SiC | 8 | 5 |

Examples 33 to 36

A cylindrical brush (5 cm in diameter) (made of nylon in Examples 33 and 34, rayon in Example 35, and rabbit hair in Example 36; size of hair was about 10 to 20 μm thick and about 10 mm long) was rotated at 300 rpm under being pressed against the photosensitive layer to conduct brush abrasion for roughening the surface of the organic photosensitive member.

Examples 37 and 38

A sand blasting technique was applied for roughening the surface of the organic photosensitive layer by using SiC particles of about 0.7 μm in diameter, which were ened in a manner similar to Examples 23 to 32 except for so high a rotating speed of buff as 1,200 rpm, heavy buff loads (15 kg in Comparative Example 11, 8 kg in Comparative Example 12 and 10 kg in Comparative Example 13) and abrasive with large particle size as shown in Table 5.

Comparative Example 14

The surface of the photosensitive layer was roughened in a manner similar to Examples 37 and 38 except for using SiC particles of about 2 μm in diameter in the sand blasting method.

The degree of roughening of the surface of the photosensitive layer was expressed in terms of ten point-mean roughness (Rz), maximum height (Rt), center line mean roughness (Ra), square mean roughness (RMS) and mean mountain distance of roughened surface (Sm).

Finally, on the organic photosensitive layers (a) and (b) prepared above was formed the surface protective layer of PAC (1), PAC (2), $Al_2O_3$ layer or SiO layer by the steps described above. The sensitivity lowering, the layer defect and the adhesive property were evaluated by the same methods as described previously in this specification.

The results are summarized in Table 4.

Total Evaluation

The photosensitive members obtained in Examples 23 to 28 and 32 showed good adhesive property and no layer defect. Lowering of sensitivity and black and white thread-like image noises were not brought about.

The photosensitive member in which the photosensitive layer was roughened under light conditions as in Example 29 and those prepared after roughening under heavy conditions as in Examples 30, 31, 37 and 38 did give not necessarily most adequate state of roughening but they were free of problem in practical utilization.

The photosensitive members obtained in Examples 33 and 37 were also free of problem in practical use.

The photosensitive members obtained Comparative Examples 9 and 10 showed remarkable lowering of sensitivity, black thread-like image noise and somewhat poor adhesive property.

The photosensitive members obtained in Comparative Examples 11 to 13 hardly showed lowering of sensitivity and occurrence of black thread-like image noises, but some white thread-like noise due to abrasion scratches and filming of toner were observed and there was also a problem in regard to the adhesive property of the layer.

The photosensitive member obtained in Comparative Example 14 showed almost no lowering of sensitivity and no occurrence of black thread-like image noise, but filming of toner was found to some extent and there was also a problem in regard to the adhesive property of layer. These results show the superiority of the present invention.

What is claimed is:

1. An electrophotographic element comprising
a substrate;
a photoconductive layer formed on the substrate, the surface of the photoconductive layer roughened by a mechanical abrasion technique; and
a vacuum thin surface protective layer formed on the photoconductive layer, having a center line mean roughness (Ra) of from 0.008 to 0.025 μm and a maximum roughness (Rt) of from 0.05 to 0.4 μm, a ten point-mean roughness (Rz) of from 0.045 to 0.35 μm, a square mean roughness (RMS) of from 0.009 to 0.035 μm and a mean mountain distance (Sm) of roughed surface of not larger than 30 μm.

2. An electrophotographic element as claimed in claim 1, wherein the surface protective layer is an amorphous carbon deposition layer formed by plasma-CVD technique.

3. An electrophotographic element as claimed in claim 1, wherein a surface of the photoconductive layer opposite to the interface in contact with the substrate is roughened by a sand blasting method.

4. An electrophotographic element as claimed in claim 1, wherein the surface protective layer has a thickness of from 0.01 to 5 μm.

5. An electrophotographic element comprising
a substrate;
a photoconductive layer formed on the substrate, a surface of the photoconductive layer roughened and having innumerable linear scratches crossing each other; and
a vacuum thin surface protective layer formed on the photoconductive layer, having a layer thickness of from 0.01 to 5 μm, and the linear scratches having a crossing angle ($\theta$) of from 30° to 150° and an inclination angle ($\alpha$, $\beta$) of from 15° to 75°, a pitch (l) of not larger than 200 μm, a width (w) of not larger than 30 μm, a maximum roughness (Rt) of from 0.05 to 0.4 μm and a center lien mean roughness (Ra) of from 0.008 to 0.025 μm.

6. An electrophotographic element as claimed in claim 5, wherein a surface of the photoconductive layer is roughened by a mechanical abrasion technique.

7. An electrophotographic element as claimed in claim 5, wherein a surface part of the photoconductive layer opposite to the interface in contact with the substrate is composed of a coated layer with a resin component as a major component and the surface protective layer is an amorphous carbon deposition layer formed by plasma-CVD technique.

8. An electrophotographic element comprising
a substrate;
a photoconductive layer formed on the substrate;
a resin layer formed on the photoconductive layer, a surface of the resin layer roughened to have innumerable linear scratches crossing each other; and
a vacuum thin surface protective layer formed on the resin layer, having a layer thickness of from 0.01 to 5 μm, and the linear scratches having a crossing angle ($\theta$) of from 30° to 150° and an inclination angle ($\alpha$, $\beta$) of from 15° to 75°, a pitch (l) of not larger than 200 μm and a width (w) of not larger than 30 μm, a maximum roughness (Rt) of from 0.05 to 0.4 μm and a center line mean roughness (Ra) of from 0.008 to 0.025 μm.

9. An electrophotographic element comprising
a substrate;
a photoconductive layer formed on the substrate;
a resin layer formed on the photoconductive layer, a surface of the resin layer roughened by a mechanical abrasion technique; and
a vacuum thin surface protective layer, having a center line mean roughness (Ra) of from 0.008 to 0.025 μm and a maximum roughness (Rt) of from 0.05 to 0.4 μm, a ten point-mean roughness (Rz) of from 0.045 to 0.35 μm, a square mean roughness (RMS) of from 0.009 to 0.035 μm and a mean mountain distance (Sm) of roughed surface of not larger than 30 μm.

10. An electrophotographic element as claimed in claim 9, wherein the surface protective layer has a thickness of from 0.01 to 5 μm.

11. An electrophotographic element as claimed in claim 9, wherein a resin layer is further formed on the surface of the photoconductive layer and the surface protective layer is an amorphous carbon deposition layer formed on the resin layer by plasma-CVD technique.

* * * * *

UNITED STATES PATENT AND TRADEMARK OFFICE

CERTIFICATE OF CORRECTION

PATENT NO. : 5,242,776

DATED : September 7, 1993

INVENTOR(S) : Isao DOI et al

It is certified that error appears in the above-indentified patent and that said Letters Patent is hereby corrected as shown below:

TITLE PAGE:

In Section [75], delete "Toyonaki" and insert -- Toyonaka --.

Signed and Sealed this

Twenty-ninth Day of March, 1994

Bruce Lehman

*Attest:*

BRUCE LEHMAN

*Attesting Officer*

*Commissioner of Patents and Trademarks*